US006671896B2

(12) United States Patent
Tse

(10) Patent No.: US 6,671,896 B2
(45) Date of Patent: Jan. 6, 2004

(54) SUPPORT FOR HAND-HELD SHOWER-HEAD

(75) Inventor: Hing Fai Tse, New Territories (HK)

(73) Assignee: Brand New Technology Ltd., Kowloon Bay (HK)

( * ) Notice: Subject to any disclaimer, the term of this patent is extended or adjusted under 35 U.S.C. 154(b) by 0 days.

(21) Appl. No.: 10/159,277

(22) Filed: Jun. 3, 2002

(65) Prior Publication Data

US 2003/0221251 A1 Dec. 4, 2003

(51) Int. Cl.[7] ..... A47K 3/20
(52) U.S. Cl. ..... 4/570; 248/295.11
(58) Field of Search ..... 4/570, 568, 567, 4/615, 601, 605; 239/282, 283; 248/218.4, 219.4, 219.3, 229.13, 229.15, 230.6, 231.71, 231.85, 227.3, 230.1, 266.11, 295.11, 296.1, 316.7, 309.1

(56) References Cited

U.S. PATENT DOCUMENTS 4,174,822 A * 11/1979 Larsson ..... 248/75
5,277,391 A * 1/1994 Haug et al. ..... 248/219.3
5,481,765 A * 1/1996 Wang ..... 4/605
5,632,049 A * 5/1997 Chen ..... 4/570
5,749,552 A * 5/1998 Fan ..... 248/205.8
5,833,192 A * 11/1998 Buhrman ..... 248/295.11
6,502,796 B1 * 1/2003 Wales ..... 248/316.1

* cited by examiner

*Primary Examiner*—Gregory Huson
*Assistant Examiner*—Huyen Le
(74) *Attorney, Agent, or Firm*—Leydig, Voit & Mayer, Ltd.

(57) ABSTRACT

A support for a hand-held shower-head includes a rod, a support bracket mounted proximate the first end of the rod and removably engaging the pipe of a fixed shower-head without the aid of tools, and a shower-head holder slidably mounted on and proximate the second end of the rod. The support bracket includes a shoulder bracket with a channel for removably receiving the pipe of the fixed shower-head and a clamp for releasably securing the support bracket to the rod. The shoulder bracket and clamp are rotatably joined. The openings in the channel have tabs to facilitate retention of the pipe within the channel.

5 Claims, 4 Drawing Sheets

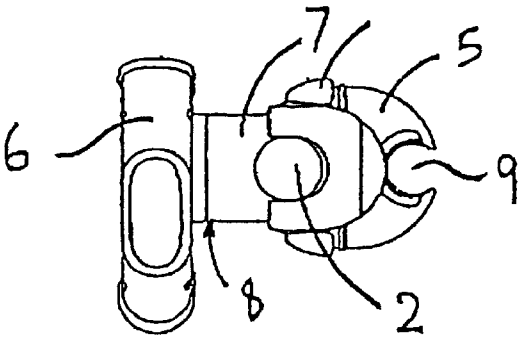
FIGURE 4
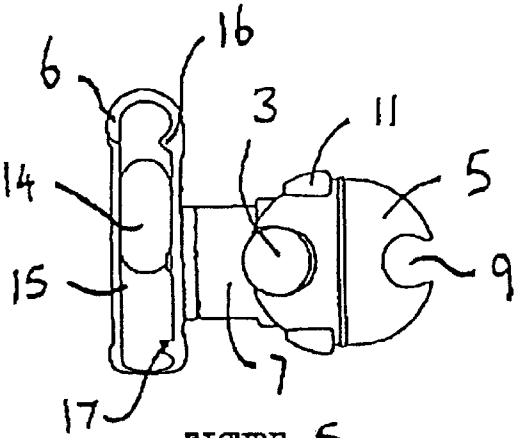
FIGURE 5
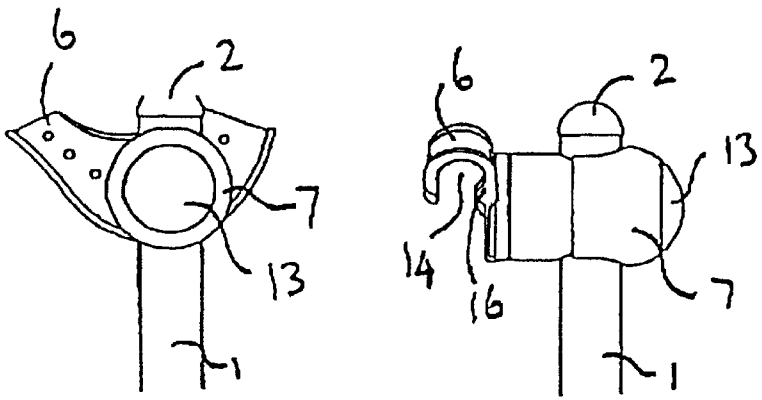
FIGURE 7
FIGURE 6
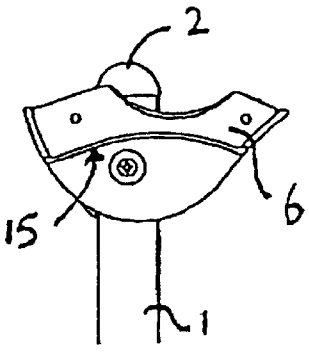
FIGURE 8
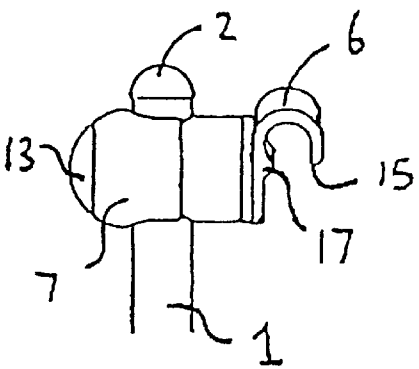
FIGURE 9

SUPPORT FOR HAND-HELD SHOWER-HEAD

BACKGROUND OF THE INVENTION

1. Field of the Invention

The invention relates to a support for mounting a hand-held shower-head in a shower cubical. In particular, the invention relates to a support that can be removed without damage to the wall.

2. Background Information

Typical hand-held shower-head supports comprise an elongate rod secured to a shower cubical wall by mounting brackets proximate its two ends. Movably affixed to the rod is a shower-head holder. The support is usually secured to the wall by means such as double sided tape, adhesives, or fasteners, such as screws, which penetrate the wall surface.

Shower cubical walls are typically covered with expensive materials that, amongst other things, protect the wall from water/moisture damage. If it is desirable to remove the hand-held shower-head support from the shower cubical a problem arises in that known means for securing the support often damage the cubical wall surface. Repairing the wall covering can be difficult and time consuming. If the wall covering is not repaired, water/moisture damage can occur to the wall behind the covering.

SUMMARY OF THE INVENTION

It is an object of the present invention to provide a support for a hand-held shower-head that overcomes or at least ameliorate the above mentioned problem.

According to a first aspect of the invention there is provided a support for a hand-held shower-head including:

a rod having first and second ends, a support bracket mounted proximate the first end of the rod, the support bracket including a channel to removably receive a pipe of a fixed shower-head and being engagable and removably from the pipe without the aid of a tool, and a shower-head holder slidably mounted proximate the second end of the rod.

Preferably, the support bracket includes a first portion comprising a shoulder bracket, wherein the channel adapted to removably receive the pipe of the fixed shower-head is in the shoulder bracket, and a second portion comprising a clamp for securing the support bracket to the rod, the first and second portions being rotatably joined.

Preferably, the shoulder bracket and channel are bent to receive a generally bent pipe within the channel.

Preferably, the support includes one or more tabs proximate an opening of the channel to facilitate retention of the pipe within the channel.

According to a second aspect of the invention there is provided a support for a hand-held shower-head including:

a rod having first and second ends, a support bracket mounted proximate the first end of the rod, said support bracket including a shoulder bracket having an channel in it adapted to removably receive a pipe of a fixed shower-head, and a clamp adapted to engage the rod, the shoulder bracket and clamp being rotatably joined, wherein the channel has one or more tabs proximate an opening to facilitate retention of the pipe within the channel, and a shower-head holder slidably mounted proximate the second end of the rod.

Preferably, the clamp of the support bracket is slidaly engaged with the rod.

Further aspects of the invention will become apparent from the following description, which is given by way of example only.

BRIEF DESCRIPTION OF THE DRAWINGS

Embodiments of the invention will now be describe with reference to the accompanying drawings in which:

FIG. 4 is a top view of the support, FIG. 5 is a bottom view of a support, FIG. 6 is a first side view of a shoulder bracket for the support, FIG. 7 is a first end view of the shoulder bracket, FIG. 8 is a second side view of the shoulder bracket, FIG. 9 is a second end view of the shoulder bracket.

In the drawings like reference numerals represent like elements.

DESCRIPTION OF THE PREFERRED EMBODIMENTS

Figure 1:
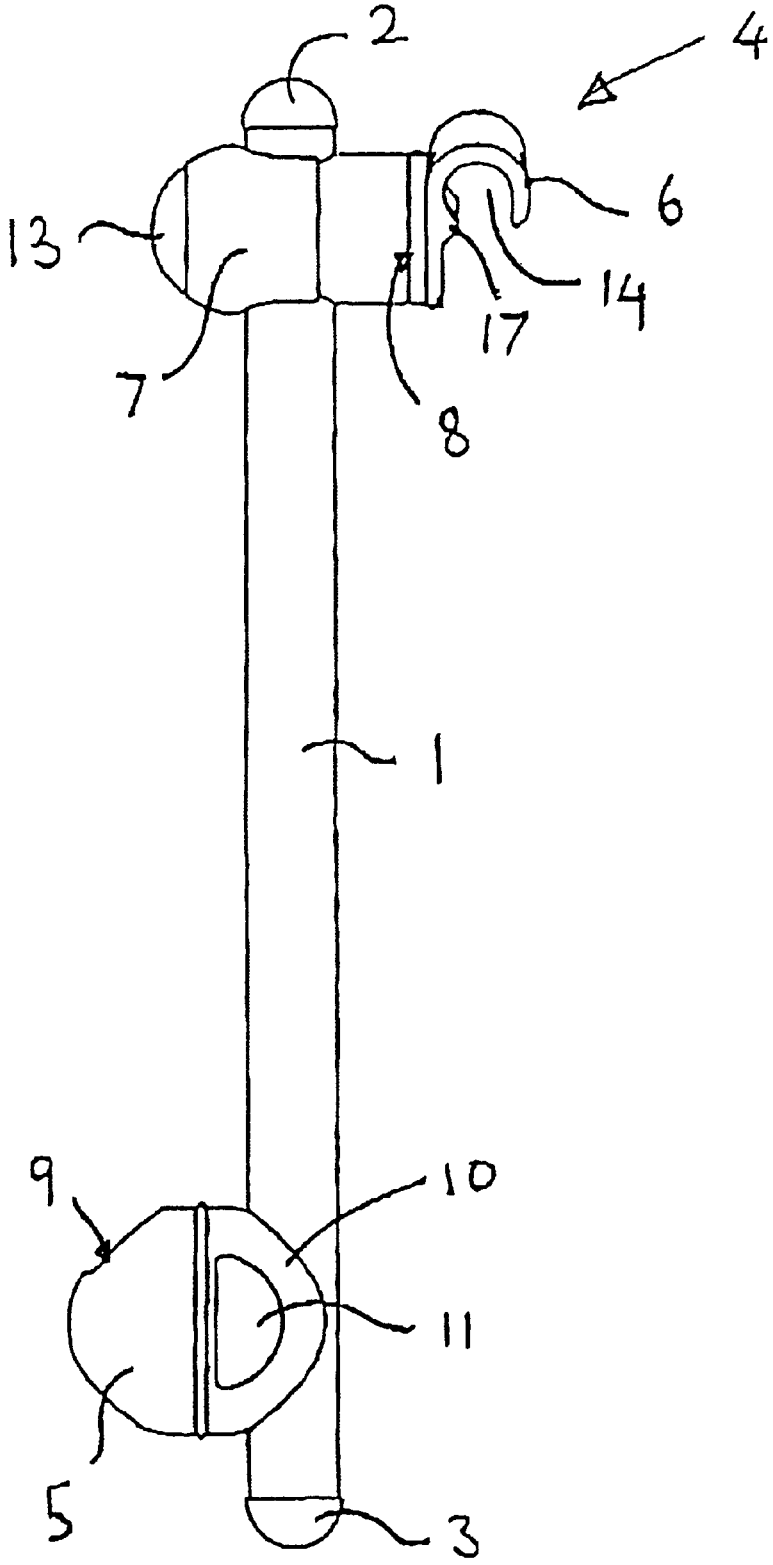
FIG. 1 is an elevation view of a support for a hand-held shower-head according to the invention.
Figure 2:
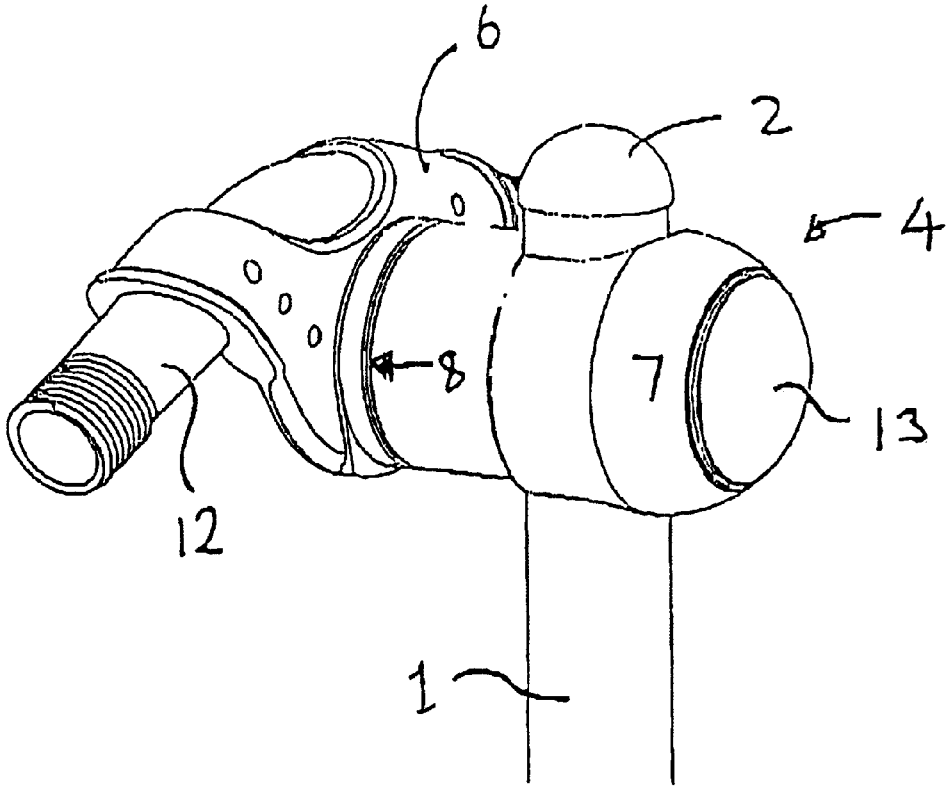
FIG. 2 is a perspective view of the shoulder bracket engaged with a fixed shower-head pipe.
Figure 3:
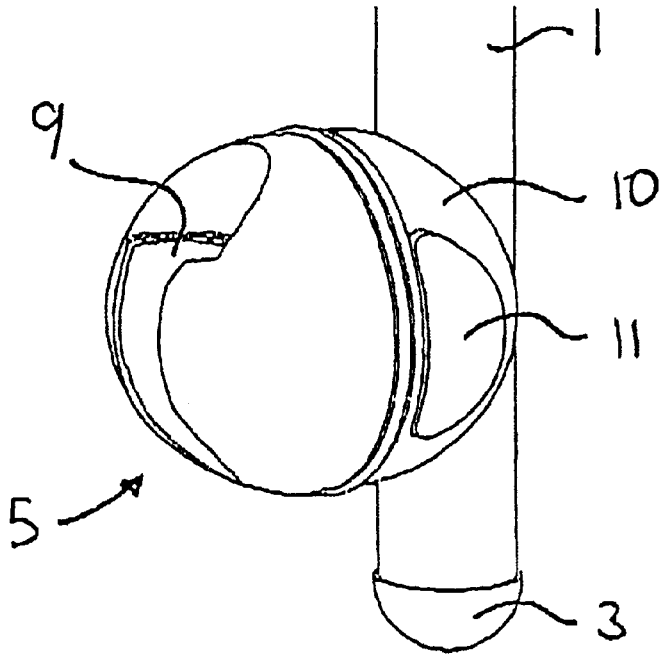
FIG. 3 is a perspective view of the shower-head holder.
Figure 13:
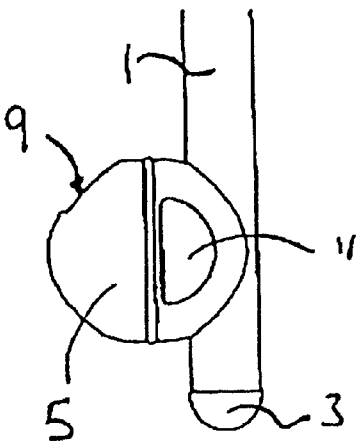
FIG. 13 is a second side view of the shower-head holder.
Figure 12:
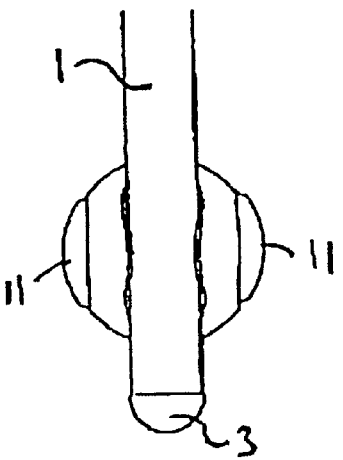
FIG. 12 is a second end view of the shower-head holder.
Figure 11:
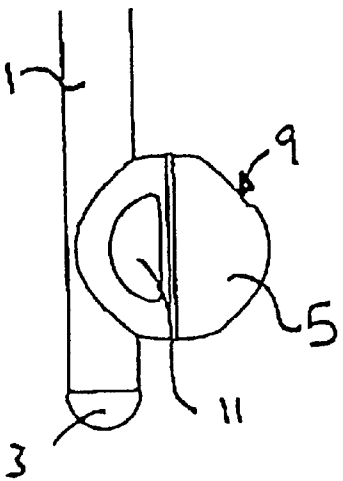
FIG. 11 is a first side view of the shower-head holder.
Figure 10:
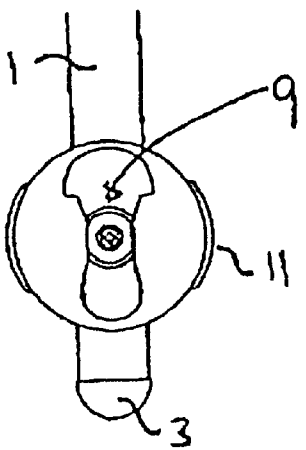
FIG. 10 is a first end view of a shower-head holder for the support.

Referring to FIGS. 1 to 3, there shown is a support for a hand-held shower-head according to the invention. The support includes a rod 1 having first and second end 2, 3 respectively. Slidably engage proximate first end 2 of rod 1 is a support bracket 4 adapted to removably hook over the pipe of the fixed shower-head without the aid of tools. The support bracket 4 includes a first shoulder bracket portion 6 and a second clamp portion 7. The shoulder portion 6 and clamp portion 7 are rotatably jointed at a rotatable connection point 8.

Proximate the second end 3 of rod 1 is a shower-head holder 5. The shower-head holder 5 has a slot portion 9 for receiving a hand-held shower-head, in known manner, to direct water therefrom toward a person taking a shower. A clamp portion 10 secures shower-head holder 5 on rod 1 in known manner. Button 11 is pushed to facilitate movement of the shower-head holder 5 up and down rod 1 to adjust the water spout height.

The shoulder portion 6 of support bracket 4 is adapted to "hook" over a water pipe 12 (in FIG. 2) of a fixed shower-head. The shoulder bracket 6 is bend to allow it to accommodate typically bent shower pipes 12. Rotatable joint 8 between shoulder portion 6 and clamp portion 7 allows adjustment of rod 1 to a suitable angle from the normal substantially vertical position. Clamp portion 7 includes a push button 13 for releasing the clamp and allowing rod 1 to slide therethrough. This permits height adjustment at support bracket 4.

Referring to FIGS. 4 to 9, the substantially elongate shoulder bracket 6 has an elongate channel 14, with open edge 15, therein for receiving the pipe 12 of the fixed shower-head. At each end of elongate channel 14, proximate open edge 15, are lips, or tabs, 16, 17 to provide frictional resistance when shoulder portion 6 is hooked over pipe 12. Lips/tabs 16, 17 may be inwardly biased to holder shoulder bracket 6 securely over pipe 12 and in place. The resistance of the lips/tabs can be easily overcome to facilitate quick removal, and replacement, of the support without the aid of tools.

The support is made from known materials, for example, thermoplastic, ABS and the like. The shoulder bracket 6 and lips/tabs 16, 17 are stiff but suitable deformable to facilitate placement and removal from pipe 12.

Thus according to the invention a support for a hand-held shower-head is removably secure to the pipe 12 of the fixed shower-head and has no connection to the lining of the shower cubical walls. The support can be readily and quickly removed and replaced, when needs be, without the aid of tools or damage to the cubical wall surface.

Where in the foregoing description reference has been made to integers or elements have known equivalents then such are included as if individually set forth herein.

Embodiments of the invention have been described, however it is understood that variations, improvement or modifications can take place without departure from the spirit of the invention or scope of the appended claims.

What is claimed is:

1. A support for a hand-held shower-head including:

a rod having first and second ends, a support bracket mounted proximate the first end of the rod, the support bracket including a channel for removably receiving a pipe of a fixed shower-head and engagable and removable from the pipe without aid of a tool, a first portion comprising a shoulder bracket, wherein the channel is in the shoulder bracket, and a second portion comprising a clamp for securing the support bracket to the rod, wherein the first and second portions are rotatably joined, and a shower-head holder slidably mounted on the rod, proximate the second end of the rod.

2. The support for a hand-held shower-head as claimed in claim 1 wherein the shoulder bracket and channel are bent for receiving a generally bent pipe within the channel.

3. A support for a hand-held shower-head as claimed in claim 1 including at least one tab proximate an opening of the channel for facilitating retention of the pipe within the channel.

4. A support for a hand-held shower-head including:

a rod having first and second ends, a support bracket mounted proximate the first end of the rod, said support bracket including a shoulder bracket having a channel for removably receiving a pipe of a fixed shower-head, and a clamp for engaging the rod, the shoulder bracket and clamp being rotatably joined, wherein the channel has at least one tab proximate an opening for facilitating retention of the pipe within the channel, and a shower-head holder slidably mounted on the rod, proximate the second end of the rod.

5. The support for a hand-held shower-head as claimed in claim 4 wherein the clamp of the support bracket slidably engages the rod.

* * * * *